United States Patent [19]

Fox et al.

[11] Patent Number: 5,015,208

[45] Date of Patent: May 14, 1991

[54] TORSO WRAP FOR BODY SURFING

[76] Inventors: John W. Fox; Rod Rigole; Mechael Rubin, all of 17500 Red Hill, #200, Irvine, Calif. 92714

[21] Appl. No.: 234,337

[22] Filed: Aug. 18, 1988

[51] Int. Cl.[5] ..... A63C 15/02

[52] U.S. Cl. ..... 441/55; 441/65

[58] Field of Search ..... 441/55, 65, 79, 108, 441/113, 136, 84, 117, 69, 79

[56] References Cited

U.S. PATENT DOCUMENTS

| | | | |
|---|---|---|---|
| 1,879,468 | 9/1932 | Jakowski | 441/55 |
| 3,803,652 | 4/1974 | Uyehara | 441/117 |
| 4,397,636 | 8/1983 | Ganshaw | 441/65 |

FOREIGN PATENT DOCUMENTS

| | | | |
|---|---|---|---|
| 745093 | 5/1933 | France | 441/55 |
| 1332642 | 10/1963 | France | 441/55 |

*Primary Examiner*—Sherman D. Basinger
*Assistant Examiner*—Stephen P. Avila
*Attorney, Agent, or Firm*—Frank Frisenda

[57] ABSTRACT

The present invention provides an improved torso wrap member for body surfing. In one embodied form, the unique torso wrap member comprises a plural laterally spaced fin members which are oriented to project outwardly from the front of a body surfer's torso. The fin members extend from a flexible support disposed within the torso wrap member to be worn by the body surfer. The inventive torso wrap provides the surfer with improved buoyancy, stability and control of movement on a wave face. Moreover, the inventive torso wrap member provides the body surfer with the ability to gain maximum maneuverability from large and small waves of varied conditions and further provides for lengthened enjoyable rides of waves.

6 Claims, 2 Drawing Sheets

TORSO WRAP FOR BODY SURFING

BACKGROUND OF THE INVENTION

1. Field of the Invention

The subject invention relates to body surfing, and more particularly to a body mounted attachment for body surfing. In one embodied form, the disclosed invention comprises a pair of laterally spaced plastic fins in a prescribed orientation mounted to a flexible support and an adjustable belt.

2. Description of the Prior Art

Surfing enthusiasts have long enjoyed water sports involving the ability to ride a wave. Surfing is a vastly popular sport which sometimes involves the use of a board upon which the surfer stands or lies flat on his belly to hydroplane down the front face of a wave. A pair of fins (skaegs) attached to the underside of the board provide the surfer with the ability to control the stability of his ride and to control the direction and position of the board on the wave face. For instance, the surfer can control his movement along a wave face by shifting the position of his body weight. Surfing, however, can be a difficult sport for the novice without the proper equipment and training.

Body surfing is another way to enjoy the thrill of a wave. Body surfer's, generally, simply extend their bodies horizontally, projecting their arms forward and in line with their body while allowing the breaking wave to drive them shoreward with the surf. To the body surfer, it is important to be able to ride waves of varied sizes, to enjoy a stable ride and to be able to control direction and position on a wave face. Since a body surfer rarely uses any equipment other than swim fins, it is quite difficult for a body surfer to adequately control the stability of his ride and control his direction and position on a wave face.

Various sporting equipment have been described in the prior act to enable a body surfer to have some control over his ride. For instance, U.S. Pat. No. 3,803,652 relates to a body mounted surfboard. This patent discloses a surfboard comprised of a rigid body which is held to the front of the body surfer's torso. The surfboard has a concave inner surface which fits against the front of the body surfer's torso. The surfboard extends across the chest of the wearer and covers a length from the wearer's chin extending the full length of the body surfer's torso. However, the surfboard must be fitted to the torso of each individual body surfer and may be hazardous to body surfers because of its rigidity.

U.S. Pat. No. 4,708,675 relates to a steerable surfing body board. As disclosed, the surfer lies flat on the board and hydroplanes down the front face of a wave. A pair of fins and rudders are provided on the lower surface of the body board. The position of the rudders are controlled from a handle on the upper surface of the body board. The body board is a relatively expensive and complicated method for riding a wave than simply body surfing.

U.S. Pat. No. 4,397,636 relates to a body surfing shirt. The shirt is stated to provide protection to the body surfer from ocean bottom scrape cuts, cold water hypothermia, jellyfish and sea nettle stings and the like. Fitted pads on the underside of the forearms and on the chest areas of the shirt provide buoyancy to the body surfer. The buoyancy enhances body surfing by providing an extra degree of lift and floatation which increases the speed and distance traveled during body surfing.

The disclosed body surfing shirt, however, does not provide any means whereby the body surfer can control the stability of his ride or control his direction and position on the wave.

Also described in the prior art are swimming devices which are comprised of fins attached to the waist or torso of the wearer. For instance, U.S. Pat. No. 3,142,485 relates to a swimming training device wherein a single rigid fin is attached to a swimmer around his waist. The fin extends from the front or back of the swimmer's torso and points fore to aft. This fin, rather than providing control of the swimmer's movement, provides resistance to the swimmer's forward movement so that the swimmer can build up his endurance. Therefor, the device is not useful in body surfing application.

U.S. Pat. No. 3,428,980 relates to teaching equipment for swimming wherein a pair of fins are mounted between the swimmer's waist. The fins are stated to laterally extend, in a nonflapping symmetrical position to restrain up and down movement. The purpose of this device is to keep the swimmer close to the surface for the so-called "porpoise kick". In contrast, this restrained movement is not desirable for full maneuverability in body surfing.

U.S. Pat. No. 3,947,906 relates to underwater swimming equipment which comprises a bladder member and fin assembly which is held to the swimmer's back by a harness assembly. The equipment provides the swimmer with buoyancy and a forward propulsive force.

Also described in the prior art are devices attached to the swimmer around his waist or torso which provide buoyancy. These are U.S. Pat. No. 1,478,959, U.S. Pat .No. 1,859,660, U.S. Pat. No. 3,084,358, U.S. Pat. No. 3,183,530, design patent number 197,820, design patent number 245,532 and design patent number 280,005.

Accordingly, those skilled in the art have recognized the need for an improved attachment for body surfing of relatively simple design which promotes buoyancy and stability to gain maximum use of large and small waves of varied conditions. The torso wrap for body surfing should also be adjustable, lightweight and sufficiently buoyant to provide flotation but not to hinder maneuverability for body surfing application. The present invention fulfills these needs.

SUMMARY OF THE INVENTION

In accordance with the present invention, an improved torso wrap for body surfing which allows the body surfer to control the stability of his ride and control his direction and position on a wave face. Further, the inventive body mounted attachment is adjustable, lightweight and sufficiently buoyant to provide flotation but not to hinder maneuverability for the body surfing application.

In a presently preferred embodiment, the improved torso wrap for body surfing comprises a pair of laterally spaced plastic fins in a prescribed orientation. The fins are generally of dorsal shape and extend for about 30° to 60° and preferably about 45° outwardly from an axis perpendicular to the lateral plane of the body.

In more detail, the fins are mounted to one or more flexible support members contained within the belt element. The support member(s) is appropriately sized to extend across the front mid-section of the wearer's torso.

Preferably, the belt element is made of durable, neoprene. The belt element may be adjustable to fit any size waist owing to its elastic fabric. Suitable fasteners of the velcro type having a pad and complimentary tab are provided at each end of the belt element for adjustable securement to the wearer.

The body mounted attachment for surfing is typically worn by wrapping the belt element around the surfer's waist section and attaching fastening means in back to achieve a snug fit. The flexible support member will accordingly be disposed across the front of the body surfer's torso with the plastic fins extending outwardly and laterally angled from the surfer's midsection. The flexible support and belt member is preferably contoured to conform to the mid-section shape of the body surfer's torso without interfering with typical swimming or body surfing motion.

To body surf, the surfer simply extends his body horizontally, projecting his arms forward and in line with his body while allowing the breaking wave to drive him shoreward. While wearing the inventive torso wrap, the surfer can now control the stability of his ride and also can control his direction and position on the wave face.

Additional objects and features of the invention will be apparent from the following description in which reference is made to the accompanying drawings.

DETAILED DESCRIPTION OF THE PREFERRED EMBODIMENTS

Figure 1:
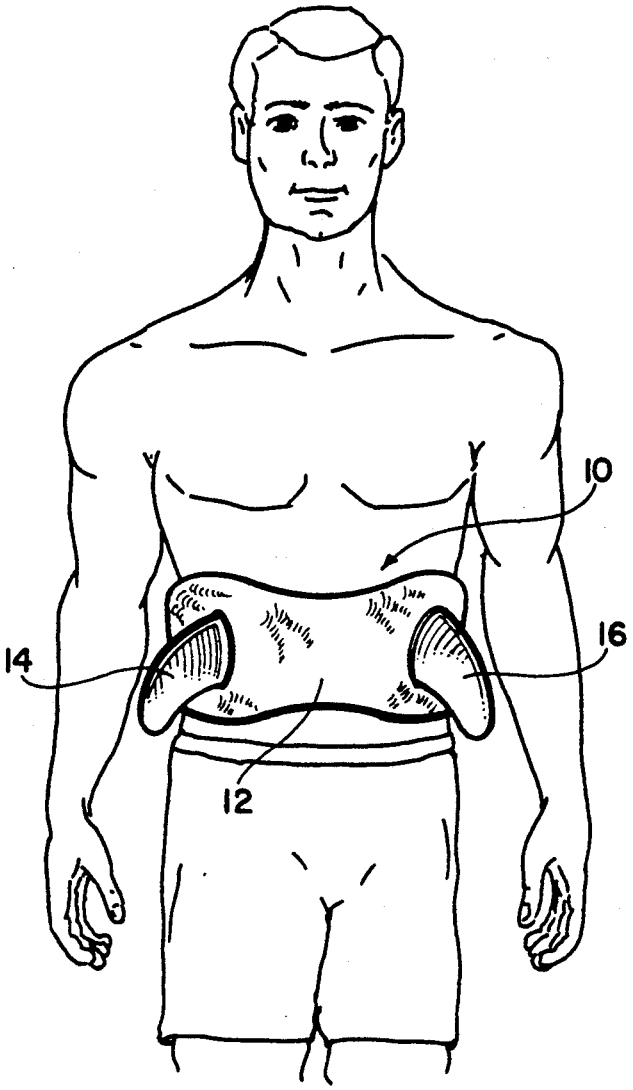
FIG. 1 is a front view of the inventive attachment mounted on a body surfer in accordance with one embodiment of the present invention.
Figure 2:
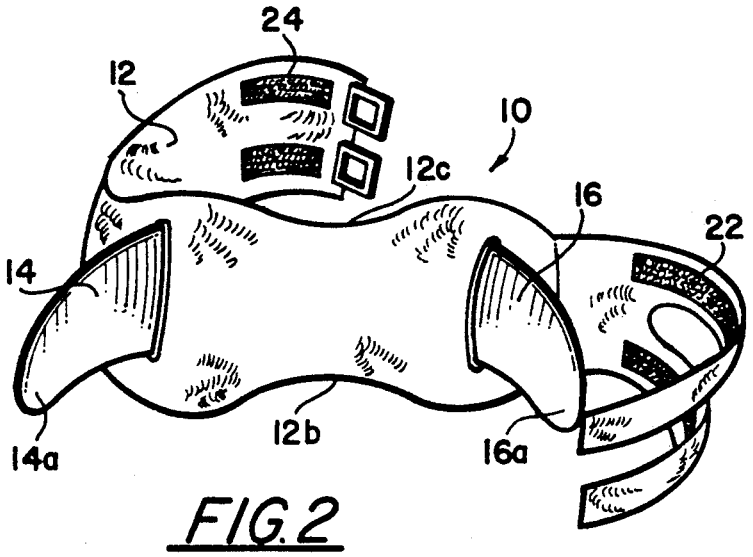
FIG. 2 is a perspective view of the embodied inventive body mounted attachment for body surfing.
Figure 3:
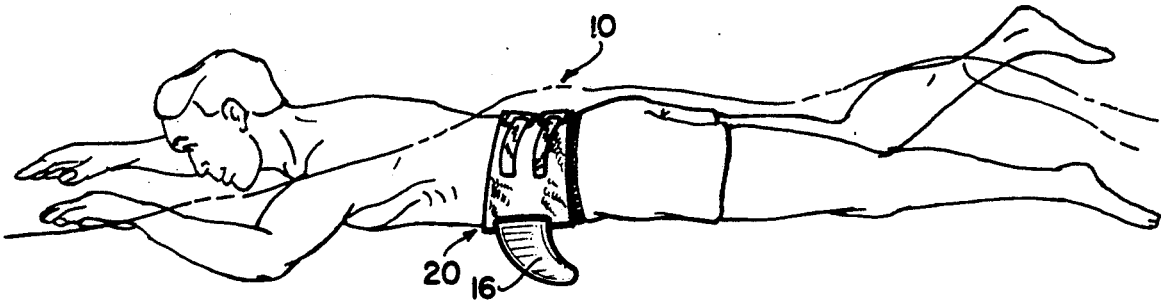
FIG. 3 is a perspective view of the embodied inventive body mounted attachment worn during body surfing.
Figure 4:
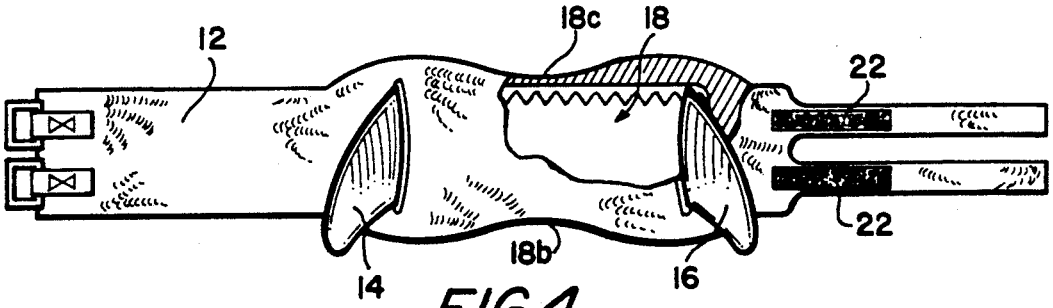
FIG. 4 is a front view of the embodied torso wrap for body surfing in accordance with the invention.

This invention provides a body mounted attachment for body surfing which allows the body surfer to control the stability of his ride and control his direction and position on a wave face. Referring to FIG. 1, the body mounted attachment for surfing 10 is attached to the body surfer by a belt element 12 worn around the body surfer's waist.

The mounted attachment for body surfing 10 has a pair of laterally spaced plastic fins 14 and 16 which provides the body surfer with the ability to control the stability of his ride and control and position on a wave face. The fins 14 and 16 are generally triangular in shape are similar to fins placed on the underside of a surfboard. Each fin is sloped downwardly, that is, with the distal ends 14*a* and 16*a* of the fins 14 and 16 directed toward the feet of the wearer.

The plastic fins 14 and 16 are secured to a flexible plastic brace member 18 by any appropriate means such as by solvent bonding adhesive or the like. The belt element 12 and flexible plastic brace member 18 is typically about six inches wide at its mid-section 18*a*, and contoured at its upper and lower portions 18 *b* and *c*. The flexible brace 18 is approximately one foot long or suitable sized to fit across the front of the body surfer's torso.

The body mounted attachment for body surfing 10 is worn by wrapping the belt element 12 around the body surfer's waist 20 and fastened by suitable means preferably velcro pad 22 and tab 24 to provide a snug adjustable fit. The flexible brace should fit across the front of the body surfer's torso with the plastic fins 14 and 16 extending outward from his body and fore to aft. Each fin 14 and 16 should protrude from approximately the hip bone of the wearer.

To body surf, the body surfer simply extends his body horizontally, projecting his arms forward and in line with his body while allowing the breaking wave to drive him shoreward with the surf until contact is made with the beach. While wearing the body mounted attachment for body surfing, the body surfer can now control the stability of his ride and also can control his direction and position of the wave.

It should be understood by those skilled in the art that various modifications can be made in the present invention without departing from the spirit and scope thereof, as described in the specifications and defined in the appended claims.

We claim:

1. An adjustable torso wrap for body surfing to be worn around a person's torso to provide dorsal shaped fins across a front mid-section of the wearer's torso, the wrap comprising in combination:

(a) a belt element to circumscribe the torso of the person;

(b) at least one flexible support member disposed on said belt element to extend across the front mid-section of the wearer's torso;

(c) a pair of laterally spaced fin members of generally dorsal shape fixedly disposed on said flexible support member to project outwardly in a range of from about 30 degrees to about 60 degrees from a perpendicular axis relative to the longitudinal axis of said flexible support member; wherein when said adjustable torso wrap is worn to circumscribe the wearer's torso; said torso wrap provides the wearer with ability to control ride stability, direction and position on a wave face during body surfing.

2. A body mounted torso wrap for body surfing as defined in claim 1 and further comprising adjustable fastening means disposed on said belt element to provide an adjustable fit to the waist.

3. A body mounted torso wrap for body surfing as defined in claim 1 wherein said fins are oriented to protrude from and above the hip bone of the body surfer.

4. A body mounted torso wrap for body surfing as defined in claim 1 wherein said belt element is tapered at its mid-section.

5. A body mounted torso wrap for body surfing as defined in claim 1 wherein said support member and fin members are constructed of durable plastic.

6. A body mounted torso wrap for body surfing as defined in claim 1 wherein said belt element is constructed of durable, mid-weight neoprene.

* * * * *